United States Patent [19]

Sausner et al.

[11] Patent Number: 4,770,178

[45] Date of Patent: Sep. 13, 1988

[54] METHOD AND CIRCUIT ARRANGEMENT FOR CONTROLLING AN INJECTION VALVE

[75] Inventors: Andreas Sausner, Frankfurt am Main; Heinz Höhne, Wiesbaden, both of Fed. Rep. of Germany

[73] Assignee: VDO Adolf Schindling AG, Frankfurt am Main, Fed. Rep. of Germany

[21] Appl. No.: 43,431

[22] Filed: Apr. 28, 1987

[30] Foreign Application Priority Data

May 15, 1986 [DE] Fed. Rep. of Germany ..... 3616356

[51] Int. Cl.[4] ..... F02D 41/20; H01H 47/32

[52] U.S. Cl. ..... 123/490; 361/154

[58] Field of Search ..... 123/490; 361/152, 154

[56] References Cited

U.S. PATENT DOCUMENTS

| | | | |
|---|---|---|---|
| 4,148,090 | 4/1979 | Kawai et al. | 361/154 X |
| 4,266,261 | 5/1981 | Streit et al. | 361/154 |
| 4,327,394 | 4/1982 | Harper | 361/154 |
| 4,347,544 | 8/1982 | Ohba | 361/154 |
| 4,452,210 | 6/1984 | Sasayama et al. | 361/154 X |
| 4,511,945 | 4/1985 | Nielsen | 361/152 X |
| 4,605,983 | 8/1986 | Harvey | 123/490 X |

*Primary Examiner*—Willis R. Wolfe

*Attorney, Agent, or Firm*—Martin A. Farber

[57] ABSTRACT

In a method for controlling an injection valve for an internal combustion engine in which the magnet coil of the injection valve is connected to pulsate current by means of a semiconductor switch to an operating voltage in such a way that, during a first time interval, a current which is sufficient to open the injection valve flows and that, following same, there is possibly a second time interval which is dependent on the intended injection time and has a current sufficient for holding the valve open. The first time interval is terminated by disconnection when the current has reached a peak valve which is dependent in accordance with a predetermined function on the operating voltage.

2 Claims, 1 Drawing Sheet

FIG.1a
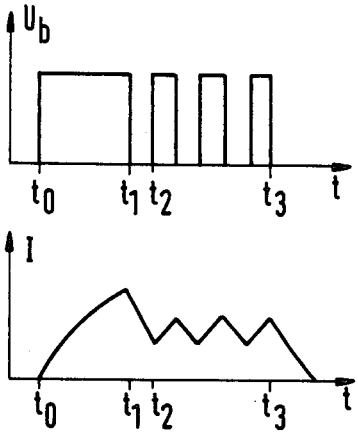
FIG.1b
FIG.1c
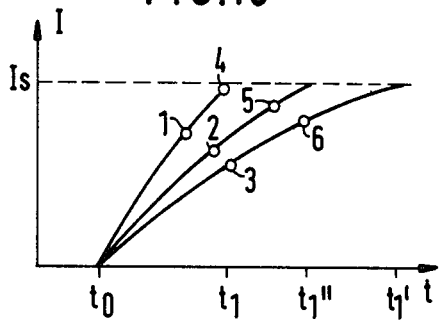
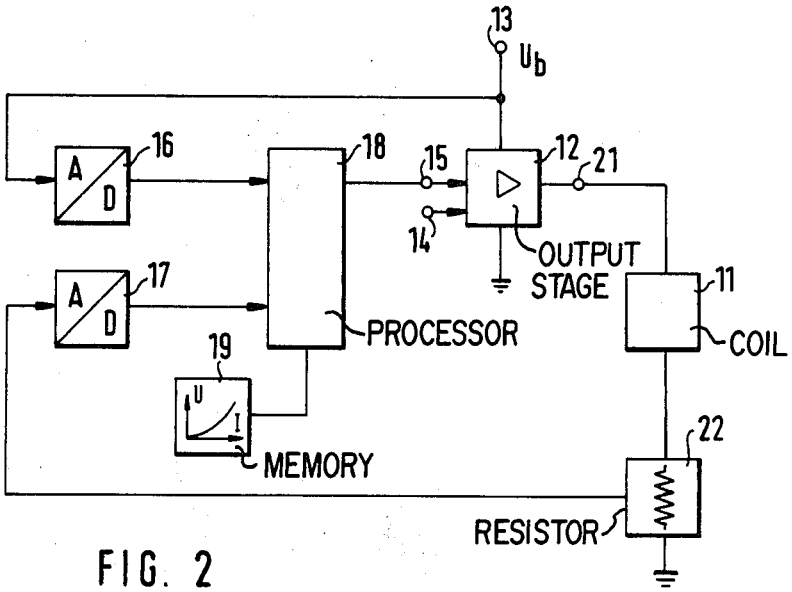
FIG. 2

METHOD AND CIRCUIT ARRANGEMENT FOR CONTROLLING AN INJECTION VALVE

FIELD AND BACKGROUND OF THE INVENTION

The invention proceeds from a method of controlling an injection valve for an internal combustion engine in which the magnet coil of the injection valve is connected for a pulsating current by means of a semiconductor switch to an operating voltage in such a way that a current sufficient to open the injection valve flows during a first time interval, and that following this, there is possibly a second time interval, dependent on the stipulated duration of injection, providing a current which is sufficient for the holding open of the valve.

Injection valves for internal combustion engines with low electrical resistance are controlled by a so-called current control. In order to open the valve, one first of all waits, after connection, until the current through the magnet coil of the valve has reached a predetermined value. The current is then shut off and a pulsating voltage applied as a function of the intended duration of injection.

The rate of rise of the current during the first interval is however dependent on the value of the operating voltage and therefore, in particular, on the state of charge and any further load on the car battery. Thus, in the event of a low operating voltage it can take a rather long period of time before the predetermined peak value is reached. This dependence makes itself disturbingly felt in the case of electronically controlled fuel injection systems. Thus, for instance, in the case of low operating voltages, the first time interval may be so long that the injection of small quantities of fuel can no longer be precisely controlled.

SUMMARY OF THE INVENTION

According to the invention, the first time interval is terminated by disconnection when the current has reached a peak value which is dependent in accordance with a predetermined function on the operating voltage.

It has, namely, been found that with a slow rise in current, such as is present with low operating voltages, the injection valve opens already with a lower current than in the case of a rapid rise in current. In known circuits in which the voltage is disconnected at a predetermined peak current, the connect time is greater in the case of low operating voltages than is necessary for the opening of the valve.

The predetermined function can depend specifically on the nature of the injection valve. In principle, however, the function will be such that the peak current is higher for higher operating voltage than for lower operating voltage.

One advantageous circuit arrangement for the carrying out of the method of the invention consists therein that the magnet coil (11) of the injection valve is connected to an output stage (12) and a current measurement resistor (22), that the current measurement resistor (22) is connected with the input of a first analog/digital converter (17), and the source of operating voltage is connected with the output stage (12) and the input of a second analog/digital converter (16), that the outputs of the analog/digital converters (16, 17) are connected to inputs of a processor (18) the output of which is connected to a control input (15) of the output stage (12), and that furthermore a memory (19) for the predetermined function is associated with the processor (18).

The invention permits of numerous embodiments.

BRIEF DESCRIPTION OF THE DRAWING

With the above and other objects and advantages in view, the present invention will become more clearly understood in connection with the detailed description of a preferred embodiment, when considered with the accompanying drawing, of which:

FIGS. 1*a*–1*c* are graphs showing the variation of the voltage and of the current in a magnet coil of an injection valve; and FIG. 2 is a block diagram of a circuit arrangement for the carrying out of the method of the invention.

DETAILED DESCRIPTION OF THE PREFERRED EMBODIMENT

FIG. 1*a* shows the variation of the voltage of a magnet coil during an injection process while FIG. 1*b* shows the variation of the current through the magnet coil during this same time. At the time $t_0$ a voltage Ub is applied to the magnet coil, resulting in an increase in the current I through the coil. At the time t1 a predetermined peak value Is is reached, whereupon the voltage is disconnected. With the output stages customarily used, the coil is simultaneously short-circuited via another transistor so that the current drops between t1 and t2. Up to the time t3, a current sufficient to keep the injection valve open is produced by a pulsating voltage. Thereafter the current drops again to zero so that the valve is closed. The amount injected is controlled by the fact that the interval of time between t1 and t3 is changed accordingly. With a minimum amount injected, the current I drops already upon the disconnection at t1 to 0.

FIG. 1*c* shows, on a different time scale, the rise in current after the connection at $t_0$ for different values of operating voltage, namely for a medium operating voltage Um, for a minimum operating voltage Umin, and for a maximum operating voltage Umax. On the individual curves there are indicated points 1, 2, 3 at which the injection valve opens. With the slot rise in current caused by the lower operating voltage, the valve opens already with a lower current.

In known circuit arrangements a constant peak value Is, indicated by the dashed line in FIG. 1*c*, is provided for the disconnecting of the voltage. Accordingly, the disconnect time t1 or t1' changes very greatly as a function of the operating voltage. With low operating voltages the injection valve disconnects much later than necessary for the opening.

In accordance with the invention, the voltage is now disconnected at different current values which depend on the operating voltage. The points 4, 5, 6 on the curves which result from this still have a sufficient safety distance from the points 1, 2, 3 which were ascertained for the opening of the valve. With minimum operating voltage the disconnect time is advanced from t1' to t1''.

In the circuit arrangement shown in FIG. 2, the magnet coil 11 of an injection valve is connected in series with a current measuring resistor 22 in the output circuit of an output stage 12. The operating voltage Ub is fed at 13 while the end of the current measurement resistor 22 facing away from the magnet coil 11 is connected to ground potential. Output stages for injection valves are known per se and need not be explained in detail in connection with the present invention. By means of a transistor, the output 21 of the output stage 12 can be connected optionally to the operating voltage Ub fed at 13 or to ground potential. With a pulse fed at 14, the magnet coil can be acted on by the operating voltage while a pulse fed at 15 effects a separation of the magnet coil 11 from the operating voltage and a connection to ground.

In order to determine the time t1 (FIGS. 1*a*–1*c*), the operating voltage Ub is fed via a first analog/digital converter 16 and the voltage drop on the current measurement resistor 22 is fed via a second analog/digital converter 17 to a processor 18.

With the processor 18 there is associated a non-volatile memory 19 in which the function by which the peak current Is is to be controlled as a function of the operating voltage Ub is stored. A corresponding value Is is now read oout from the memory 19 by the processor for the value of the operating voltage Ub fed by the analog/digital converter 16 and compared with the current value given off in each case by the analog/digital converter 17. If the value Is is reached, then the processor 18 gives off a pulse to the input 15 of the output stage, whereupon the latter separates the magnet coil 11 from the operating voltage Ub and switches it to ground, whereupon the current drops, as explained in connection with FIG. 1*b*. Operation of the processor 18 continues for a subsequent activation of the coil 11 by application of a turn-on pulse at input 14, followed by a turn-off pulse at input 15 on the output stage 12.

We claim:

1. A method of controlling an injection valve for an internal combustion engine in which the magnet coil of the injection valve is connected by means of a semiconductor switch to an operating voltage to provide current pulses with a current sufficient to open the injection valve during a first time interval, there being a second time interval during which the current flows with sufficient magnitude for the holding open of the valve, the method comprising the steps of storing a relationship of current magnitude as a function of operating voltage;

comparing current in the magnet coil with a current magnitude of said storing step; and during the first time interval, terminating a current pulse by disconnection of the current to the coil when the current has reached a peak value equal to said current magnitude of said storing step, the peak value for higher operating voltage being higher than for a lower operating voltage.

2. A circuit for regulating current flow in the coil of a fuel injector comprising:

an output stage and a current measurement resistor serially connected to said coil, said output stage being energized from a source of operating voltage to provide current pulses to said coil for opening a valve of the fuel injector;

a first analog/digital converter, the current measurement resistor being connected with the input of said first analog/digital converter;

a second analog/digital converter, a source of operating voltage being connected with the output stage and the input of the second analog/digital converter;

a processor, the outputs of the analog/digital converters being connected to inputs of said processor, an output of the processor being connected to a control input of the output stage; and a memory, said memory storing a predetermined function of current versus operating voltage for operation of said processor, said function including magnitudes of current stored in said memory; and wherein said circuit provides for the termination of current in one of said current pulses when the current has reached a peak value equal to a current magnitude stored in said memory, the peak value for higher operating voltage being higher than for a lower operating voltage.

* * * * *